US008692679B2

(12) United States Patent
Brickell

(10) Patent No.: US 8,692,679 B2
(45) Date of Patent: Apr. 8, 2014

(54) TOWER ELEVATOR ALARM SYSTEM

(75) Inventor: Christopher Gavin Brickell, Docklands (AU)

(73) Assignee: SafeWorks, LLC, Tukwila, WA (US)

( * ) Notice: Subject to any disclaimer, the term of this patent is extended or adjusted under 35 U.S.C. 154(b) by 358 days.

(21) Appl. No.: 13/121,404

(22) PCT Filed: Sep. 29, 2009

(86) PCT No.: PCT/US2009/058853

§ 371 (c)(1),
(2), (4) Date: Mar. 28, 2011

(87) PCT Pub. No.: WO2010/039735

PCT Pub. Date: Apr. 8, 2010

(65) Prior Publication Data

US 2011/0175743 A1 Jul. 21, 2011

Related U.S. Application Data

(60) Provisional application No. 61/101,433, filed on Sep. 30, 2008.

(51) Int. Cl.
*G08B 21/00* (2006.01)

(52) U.S. Cl.
USPC ..... 340/635; 340/540

(58) Field of Classification Search
USPC ..... 340/635
See application file for complete search history.

(56) References Cited

U.S. PATENT DOCUMENTS

| | | | | | |
|---|---|---|---|---|---|
| 737,635 | A * | 9/1903 | Kinnecom | 187/390 |
| 4,548,296 | A * | 10/1985 | Hasegawa | 187/275 |
| 4,713,595 | A * | 12/1987 | Yonemoto | 318/759 |
| 4,988,336 | A * | 1/1991 | Kohn | 604/67 |
| 6,516,922 | B2 * | 2/2003 | Shadkin et al. | 187/290 |
| 2002/0162705 | A1 * | 11/2002 | Shadkin et al. | 187/290 |
| 2008/0230322 | A1 * | 9/2008 | Chung | 187/250 |
| 2011/0061976 | A1 * | 3/2011 | Tiner | 187/254 |

FOREIGN PATENT DOCUMENTS

EP 1584597 A1 * 10/2005

* cited by examiner

*Primary Examiner* — Travis Hunnings
(74) *Attorney, Agent, or Firm* — Woodcock Washburn LLP

(57) ABSTRACT

An elevator within a tower, such as a wind tower, includes a traction or drum type hoist powered by an electric motor where the hoist provides the mechanism to cause the vertical ascent or descent of the elevator. An aspect of the invention is to allow the descent of the elevator to drive the electric motor arranged to act as a generator and provide regenerative braking as well as power to drive an alarm device or devices.

20 Claims, 5 Drawing Sheets

TOWER ELEVATOR ALARM SYSTEM

CROSS-REFERENCE TO RELATED APPLICATIONS

This application is the National Stage of International Application No. PCT/US2009/058853 filed Sep. 29, 2009, which claims the benefit of U.S. Provisional Application No. 61/101,433, filed Sep. 30, 2008, the disclosures of which are incorporated herein by reference in their entireties.

BACKGROUND

Many methods of providing alarms responsive to human senses are known such as audible, visual, and tactile.

As a safety measure it may be required to alert persons in a tower, for example a tower used for production of energy from wind, of the motion of an internal access elevator where a hazard may result. This is particularly important where such an elevator is not necessarily provided with a protective hoistway to prevent body parts from invading the volume corresponding to the path of the elevator throughout its range of motion, such as would be the case of elevators for public use. Such tower elevators are commonly used to transport technicians and their tools from the lower platform to the nacelle at the top of the tower, and to the intervening spaces. Additionally, such an elevator may be required to descend while unpowered, for example during a power failure. Where a power supply is not available, standard powered alarms such as a strobe light, may or may not be powered such as during a power failure.

The elevator as disclosed herein differs from an elevator used to transport the general public within a building in that it is typically but not necessarily a simpler construction and may be guided with cables tensioned between the top and base of the tower rather than using rails attached to the tower structure. Additionally, the hoist is typically mounted within the car rather than at the top of the structure.

SUMMARY

In accordance with aspects of this invention, the power for the operation of an alarm device or devices is provided by the motion of an elevator.

Typically, an elevator within a tower, such as a wind tower, includes a traction or drum type hoist powered by an electric motor where the hoist includes a primary brake to hold the elevator stationary when power is removed from the electric motor. Unpowered descent of the elevator may be by manual release of the primary brake.

Maintaining a safe unpowered descent speed are in use such as a secondary centrifugal brake. As the speed of descent increases the braking effect increases resulting in a stable, safe and limited descent speed, as is well known. An aspect of the invention is to allow the descent of the elevator to drive the electric motor arranged to act as a generator and provide regenerative braking as well as power to drive an alarm device.

According to an aspect of this invention the conversion of mechanical energy from the descent of the elevator to electrical energy is used to derive power to operate an alarm or multiple alarm devices.

As a preferred embodiment, electric power resulting from motion of the elevator may be derived from a variety of sources such as a generator incorporated as part of a centrifugal braking system, or from another source where there is relative motion between the elevator and another object or structure to cause a generator drive mechanism to generate electric power. Such mechanisms include an electric generator driven by relative motion to a suspension, guide or safety rope associated with the elevator, or a drive mechanism acting on another structure such as a proximal wall or rail.

An aspect of the invention is the use of power generation using the regenerative energy from the motion of the motor during unpowered descent. Of course, it is also possible using the appropriate mechanism to generate power in the upward direction of motion.

BRIEF DESCRIPTION OF THE DRAWINGS

The foregoing summary, as well as the following detailed description of preferred embodiments, is better understood when read in conjunction with the appended drawings. For the purposes of illustration, there are shown in the drawings exemplary embodiments; however, the present disclosure is not limited to the specific methods and instrumentalities disclosed. In the drawings.

DETAILED DESCRIPTION OF ILLUSTRATIVE EMBODIMENTS

Certain specific details are set forth in the following description and figures to provide a thorough understanding of various embodiments of the disclosure. Certain well-known details often associated with tower elevators are not set forth in the following disclosure to avoid unnecessarily obscuring the various embodiments of the disclosure. Further, those of ordinary skill in the relevant art will understand that they can practice other embodiments of the disclosure without one or more of the details described below. Finally, while various methods are described with reference to steps and sequences in the following disclosure, the description as such is for providing a clear implementation of embodiments of the disclosure, and the steps and sequences of steps should not be taken as required to practice this disclosure.

Figure 1:
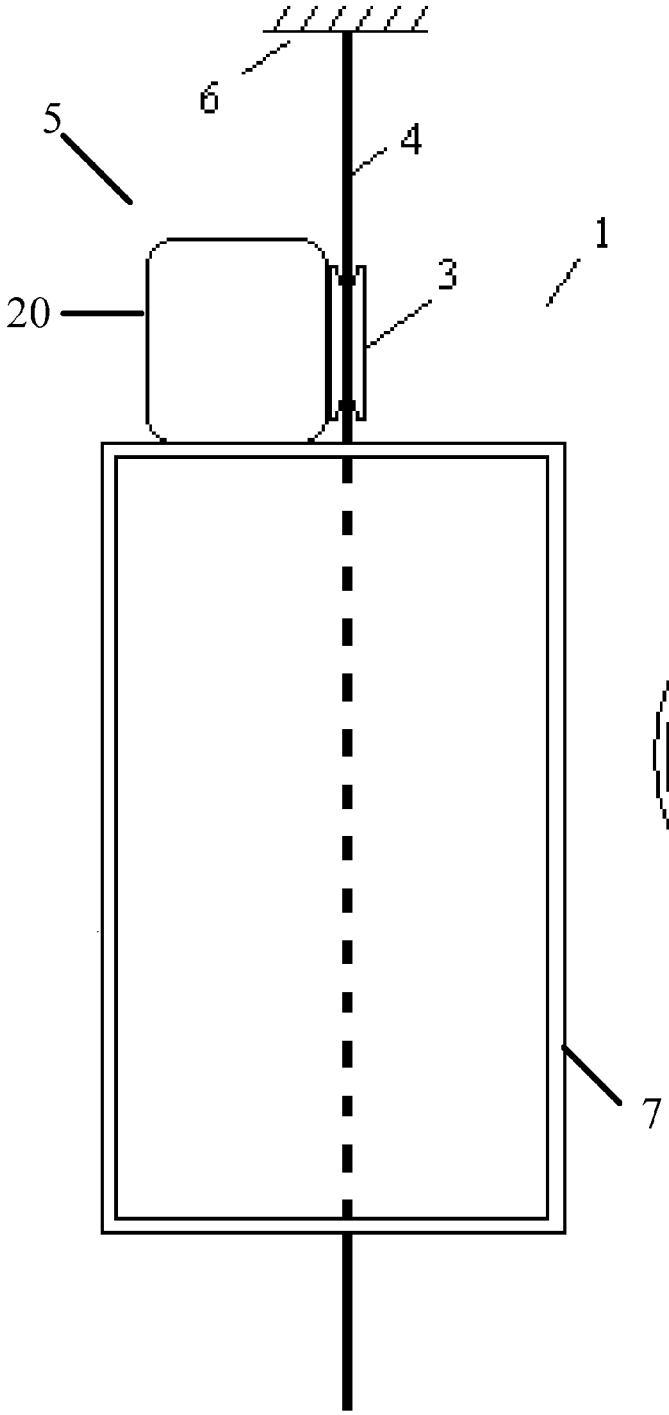
FIG. 1 shows a diagrammatic representation of an example wind tower elevator according to the invention.

FIG. 1 diagrammatically shows a typical elevator 1 installation in a wind tower. The elevator 1 has a traction hoist mechanism 5 coupled directly to the elevator cabin 7. The hoist mechanism 5 has an electric motor 20 that is coupled to and rotationally drives a sheave 3 via a reduction gearbox (not shown). Although the traction hoist is used herein to demonstrate aspects of the invention, a drum type hoist could also be used but is not further described herein.

A power source (not shown) from an external supply, for example from an outlet on a building, is selectively coupled to the electric motor. Selective application of the power source to electric motor 20 causes rotation of the sheave 3 in a clockwise or counter clockwise direction (see FIG. 1A). Elevator cabin 7 is coupled to a stationary suspension wire 4 by wrapping around sheave 3 with preferably, but not necessarily, a single turn. Suspension wire 4 is fixed to a stationary structural member 6. As such, when electric motor 20 rotates sheave 3, the rotation of sheave 3 causes elevator car 7 to effectively climb up or down suspension wire 4, depending on the direction of rotation. Preferably, when electric motor 20 is unpowered, a primary brake (not shown) is engaged to prevent rotation of the electric motor 20 thereby preventing motion of elevator cabin 7.

When the primary brake is manually released and elevator 1 is unpowered, the weight of elevator cabin 7 is sufficient to back-drive electric motor 20 through the reduction gearbox. As a result, electric motor 20 is caused to rotate, driven by friction between suspension wire 4 and sheave 3. In that case, electric motor 20 acts as a generator and outputs power.

Figure 1A:
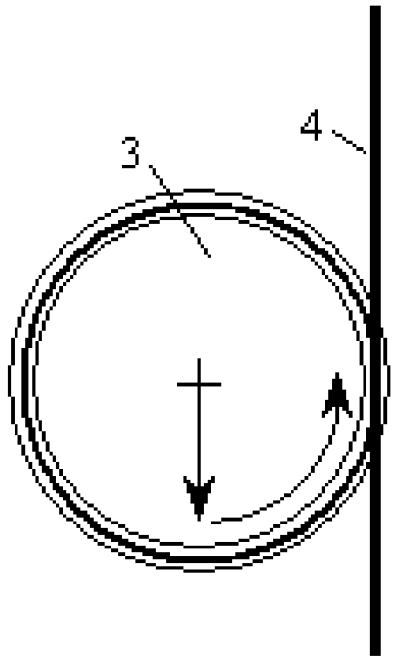
FIG. 1*a* shows a diagrammatic representation of rotation of a sheave.

FIG. 1A shows the direction of rotation of sheave 3 relative to suspension wire 4 as elevator cabin 7 descends. Of course, suspension wire 4 is drawn tightly around sheave 3 by the weight of elevator cabin 7 fastened to fixed suspension structure 6.

In various applications, elevator cabin 7 may travel vertically in an unenclosed space (a hoistway). Because the space through which the elevator travels may be at least partially unenclosed, persons at various levels in the path of the elevator cabin's hoistway could enter into the space through which elevator cabin 7 may pass. As a result, such persons are at risk of serious injury. For example, if an elevator is descending, unwitting personnel could enter elevator cabin 7 descent space and be struck by the elevator. Consequently, to enhance the safety of those in the vicinity of elevator cabin's 7 hoistway path, an alarm system is provided to give advance warning of the approach of elevator cabin 7. This is particularly true when power is lost to the elevator 1. The loss of power could result in the concomitant loss of adequate lighting thereby increasing the safety risk. In the event that power is lost to the elevator 1, elevator cabin 7 may still descend through it's hoistway. In that case, according to an aspect of the invention, power is still provided by use of the electric motor 20 to generate sufficient power to power an alarm system.

Figure 2:
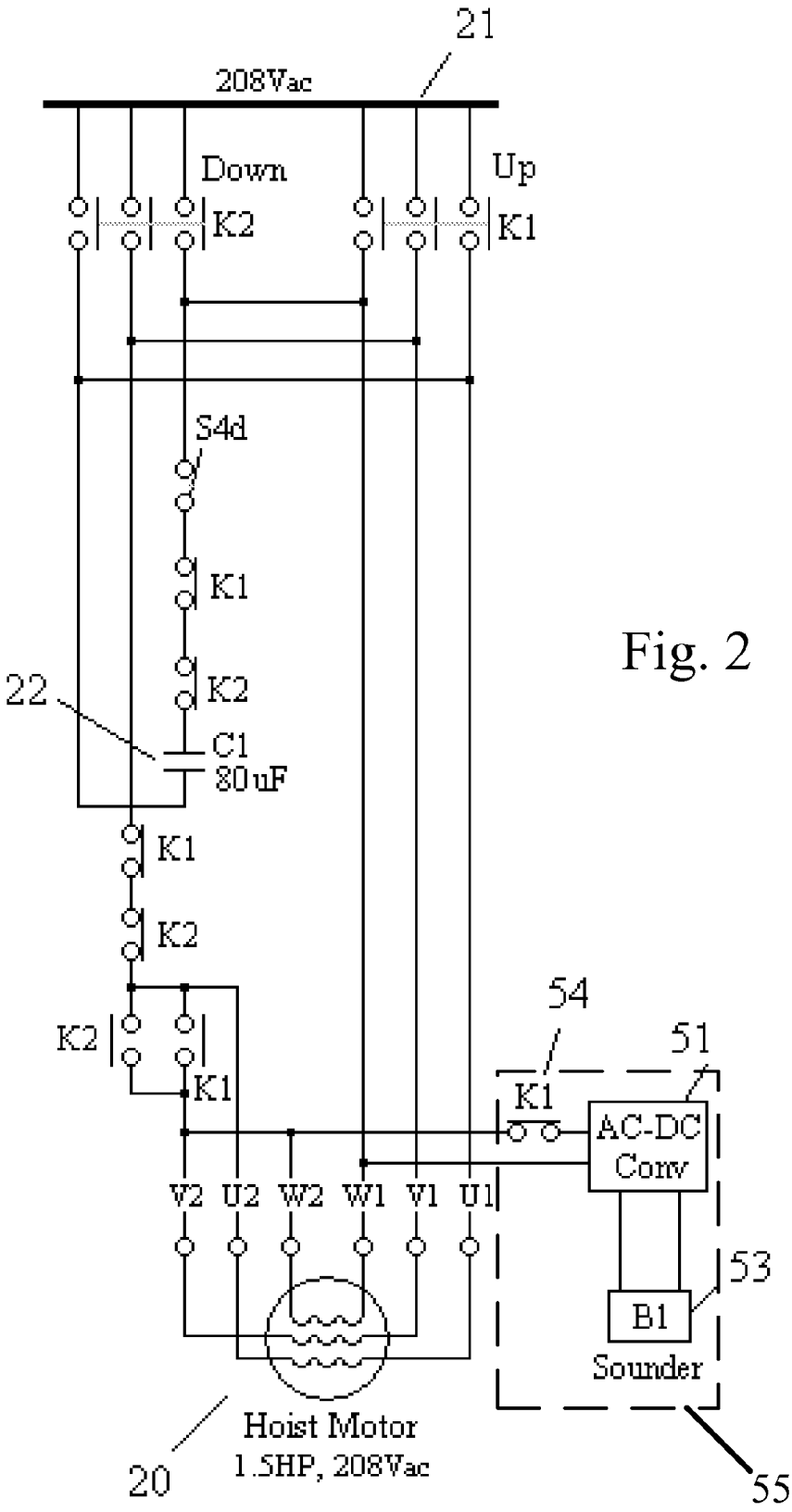
FIG. 2 shows a partial schematic embodiment of the electrical system of an example wind tower elevator according to the invention.

FIG. 2 shows a partial schematic of electrical controls 21 for electric motor 20 power management. Several of the electric contacts (K1 and K2) are shown in the unpowered state and are not further considered herein, but act to create an electrical connection status between the various windings of electric motor 20 and other elements in the schematic to enable regenerative braking.

An alarm system 55 is driven by the generated voltage from the electric motor 20 and is illustrated as comprising an AC-DC converter 51 connected via contact 54 to terminals W1 and W2 of electric motor 20. Contact 54 is optional and acts to enable alarm 53 during unpowered motion and disable alarm system 55 during powered motion should this be desired. For example, it may be the case that alarm system 55 is operation during every descent of elevator car 7. Preferably, alarm device 53 is connected by way of an AC-DC converter 51. While a DC supplied sounder 53 is shown as the alarm device, other types of alarm device may also be used such as an AC operated device, a light, or an actuator for other alternatives, including but not necessarily connection to a SCADA or wireless system or recording device. For convenience of description, a low voltage DC piezoelectric sounder will be incorporated herein as the preferred alarm device.

Of course a battery may also be provided to supply power when required; however any extrinsic supply needs additional support such as a battery charger or exercise of a replacement or replenishment function, with resulting extra costs and maintenance requirements. By using the intrinsic properties of the elevator 1 and electric motor 20, a significant advantage of permanent availability without collateral equipment is provided, resulting in lower cost and improved availability and reliability.

Figure 3:
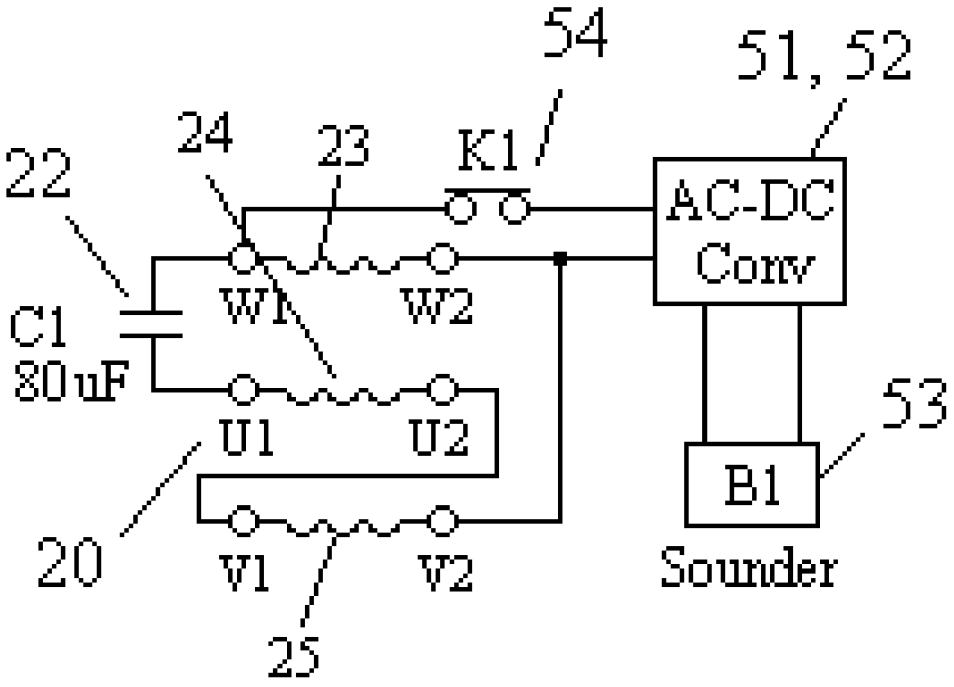
FIG. 3 shows a partial schematic embodiment of the unpowered electrical system of an example wind tower elevator according to the invention.

FIG. 3 is a diagram showing the current path for regenerative braking and power generation derived from FIG. 2. It will be seen that for a three phase motor as is typically but not necessarily used in an elevator, that each of the motor windings 23, 24, 25 is placed in series by the connections afforded by the various contacts in FIG. 2. Further, a capacitor 22 is included in the series connection with motor windings 23, 24, 25, capacitor 22 being responsible for a phase shift between voltage and current in windings 23, 24, 25 and motor rotor (not shown) such as to cause a lagging magnetic field resisting rotation drive of electric motor 20 and thereby providing regenerative braking action as is well known.

If the primary brake (not shown) is released manually, then as elevator 1 descends unpowered and friction between suspension wire 4 and sheave 3 causes electric motor 20 to rotate via the gearbox. As such, electric motor 20 will act as an electric generator resulting in electric power at the motor terminals, e.g., W1 and W2, while providing braking action, i.e. slowing the descent of the elevator car 7.

Figure 4:
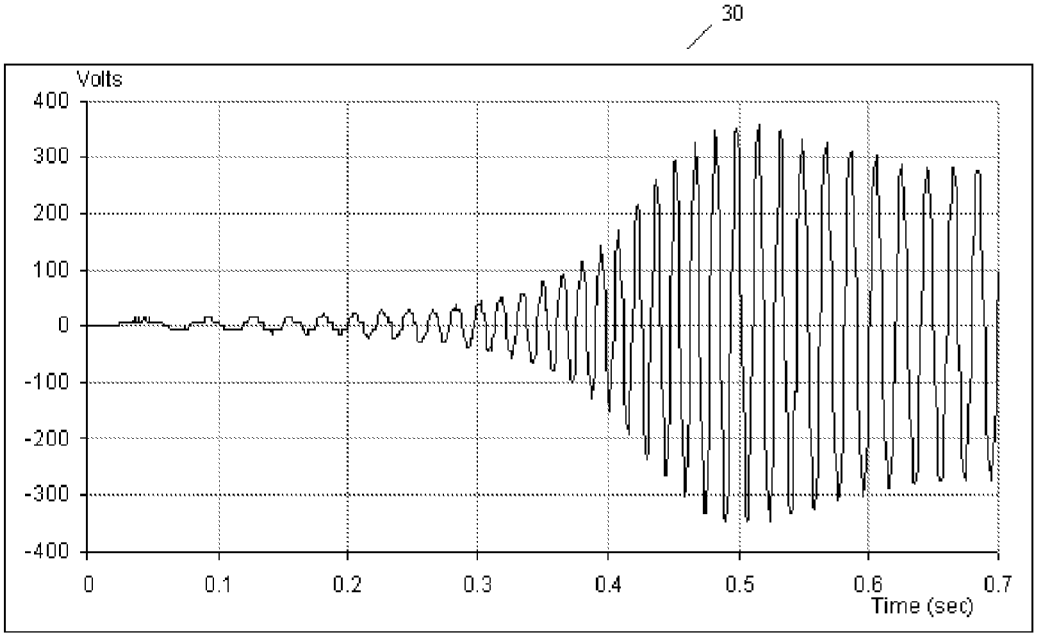
FIG. 4 shows typical waveforms characteristic of regenerative voltage according to the invention.

FIG. 4 is an oscillographic recording 30 of the generated voltage resulting from acceleration from rest of an elevator when the elevator is set into unpowered descent, measured across terminals W1 and W2 of said motor. Of course other terminals may equally be specified as the source of voltage such as W1, U1 or W2, V1, or any other combination. As depicted, the generated voltage and frequency varies widely in a range to nominally 350 Volts peak depending on the descent speed of said elevator. Typically, an elevator as described herein for a wind tower in the US will descend at a maximum speed between 35 feet per minute and 60 feet per minute. From recording 30 the generated voltage at steady descent speed is nominally 280V peak.

According to an aspect of the invention, the voltage output from electric motor 20 is, in turn, used to power alarm system 55. The motion of descent elevator car 1, cause the generation of electrical energy that is available to drive alarm system 55. As the generated voltage increases to high levels, the voltage supplied to alarm system is maintained by the AC-DC converter at an appropriate level, for example 10 V, according to the operating needs of the alarm system. A specific alarm sounder 53 may be specified to have a specified sound power output at a specified voltage. Preferably the sound level remains with a range of +/−5 dB relative to the chosen level such as 75 dB.

As should be understood from said oscillographic recording 30, a lower speed of descent results in said regenerative voltage being lower. Consequently, it is advantageous for the alarm system 55 to correspondingly operate at a lower voltage to ensure that the least descent movement results in an alarm being generated. It is also advantageous to use a means of deriving the voltage to power alarm system 55 that minimizes cost and complexity. The method herein disclosed preferably uses a low power piezoelectric sounder which require a nominal supply of 10V at 7 mA to provide a sound level of nominal 75 dB, and will also be relatively insensitive to voltage variation. In general, a light indicator will likely require more power to operate than a sounder but may also be used in place of or in addition to a sounder in some applications. A light source such as LED would be a low voltage choice.

Figure 5:
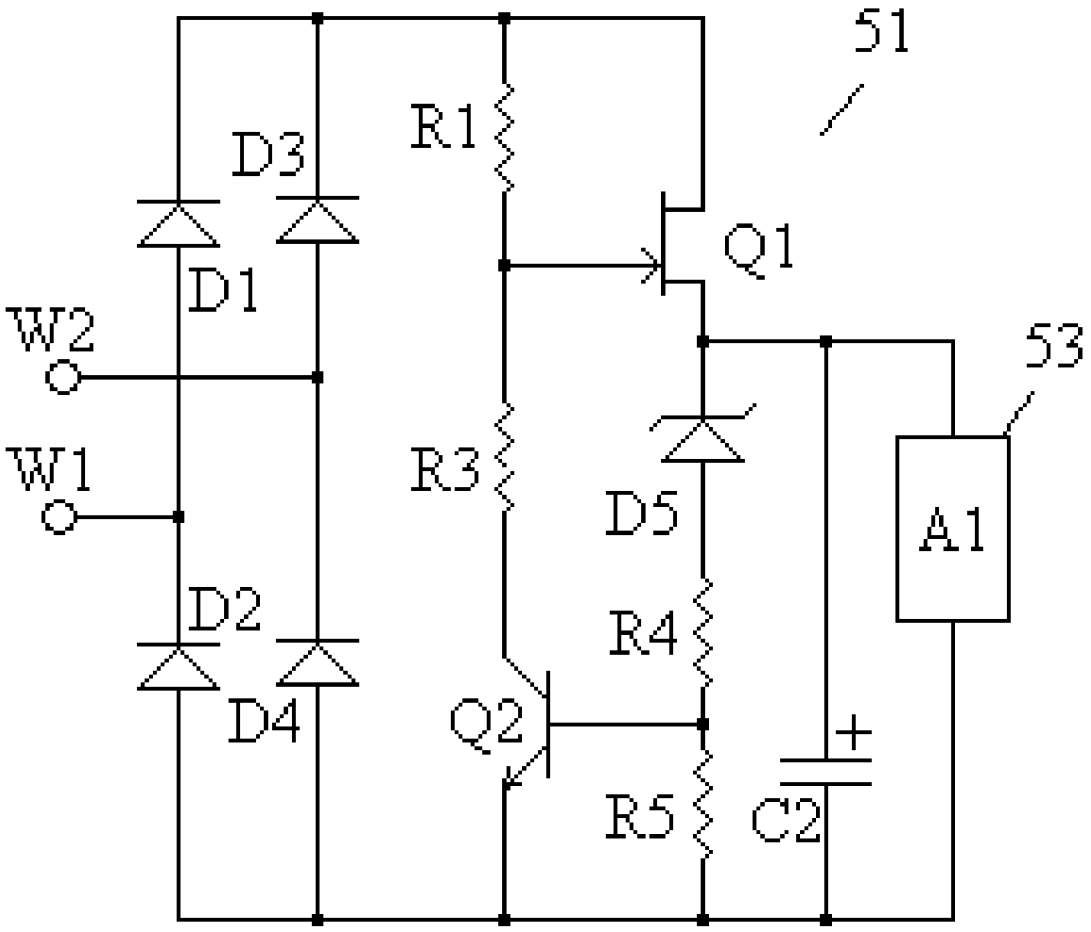
FIG. 5 shows a schematic of a preferred embodiment of a power converter according to the invention.

FIG. 5 is a circuit schematic of one embodiment of an AC-DC converter 51 capable of providing a nominally constant power source to drive alarm sounder 53 with nominally constant energy. Other embodiments are also possible to provide power to an alarm sounder or other alarm device including means not requiring conversion to DC, however this preferred embodiment is described as representative.

Diodes D1, D2, D3, and D4 comprise a full wave rectifier supplying a pulsating DC voltage to MOSFET Q1. Equally, a half wave rectifier could be employed, however improved efficacy results with a full wave rectifier. The gate of Q1 is connected to the DC supply via a high value resistor R1 (e.g., 1M) and to transistor Q2 via a further low value resistor R3 (e.g., 1 k). When the voltage on the gate of Q1 is sufficiently higher than the voltage at its drain, Q1 conducts and charges capacitor C2 causing the voltage to increase. At the same time said alarm sounder A1 53 receives voltage (power) and operates to generate an alarm sound.

As voltage on C2 increases to a point above the conduction point of zener diode D5, for example 10V, Q2 is turned on via resistor R4 (e.g., 1 k). High value resistor R5 (e.g., 100 k) is provided for stability. When Q2 turns on, the voltage at the gate of Q1 is reduced below the point where Q1 conducts, and capacitor C2 receives no further charge. At this point C2 begins to discharge through alarm sounder A1 53 and thus provides continuity of power for alarm sounder 53 until the next charging cycle.

By correct choice of components as above, the nominal voltage at the drain of Q1 is approximated by the turn on voltage of zener D5, is largely independent of the source voltage, for example at terminals W1, W2, and also above a low limit value, for example 15V peak, and is proof against overload or damage from the high voltages generated by the motor.

A three-phase motor is described herein; however, other types of generating devices could similarly be used including a separate extrinsic generator attached to or separate from the hoist motor. Also a DC or single phase induction motor could also act as an intrinsic generator and is included by implication as demonstrating the same ability to provide a voltage supply to operate an alarm device as disclosed.

As a further consideration, while the alarm device 53 is powered by voltage at the terminals of the electric motor, it is similarly feasible to use the electric current flowing through the electric motor. By use of a current transformer as is well known, power to drive an alarm device may also be provided.

The foregoing description has set forth various embodiments of the apparatus and methods via the use of diagrams and examples. While the present disclosure has been described in connection with the preferred embodiments of the various figures, it is to be understood that other similar embodiments may be used or modifications and additions may be made to the described embodiment for performing the same function of the present disclosure without deviating there from. Furthermore, it should be emphasized that aspects of the invention described herein have a variety of applications. For example, while aspects of the invention relates to elevators used for vertical transportation, it equally applies to elevators and other mechanisms used for inclined conveyance, for example a cable car disposed on a hillside.

What is claimed:

1. A tower, comprising:

an elevator cabin;

an electric motor coupled to the elevator cabin;

a sheave coupled to the electric motor;

a power source electrically coupled to said electric motor when operational so that power from the power source is selectively applied to the electric motor to cause the sheave to rotate relative to a suspension cable fixed to a structure of the tower, the sheave rotation operable to raise or lower the elevator cabin within the tower; and an alarm device electrically coupled to said electric motor such that said electric motor is operable to power the alarm device during descent of said elevator cabin without the need for power from said power source;

wherein current generated by rotation of rotor or stator winding in said electric motor is used to provide electromotive braking of the elevator cabin.

2. The tower of claim 1 wherein the tower is a wind turbine tower.

3. The tower as recited in claim 1, wherein the electric motor comprises a component of a hoist.

4. The tower as recited in claim 1, further comprising an AC to DC converter electrically coupled between the electric motor and the alarm device to control voltage applied to the alarm device.

5. The tower as recited in claim 1 wherein the alarm device comprises a sound generating device.

6. The tower as recited in claim 1 wherein the alarm device comprises a light generating device.

7. The tower as recited in claim 1 comprising a manual brake that causes the elevator cabin to stop when applied and to descend when released.

8. An apparatus for providing power to an alarm device without the need for an extrinsic power supply, comprising:

a traction hoist mechanism comprising an electric generator coupled to a sheave such that rotation of said sheave causes an electrical output from said electric generator;

an elevator cabin adapted to couple to a suspension cable such that movement of said elevator cabin in a first direction causes rotation of said sheave; and, an alarm device in electrical communication with said electric generator, said alarm device capable of generating an alarm responsive to said electrical output from said electric generator;

wherein current generated by rotation of rotor or stator winding in said electric generator is used to provide electromotive braking of the elevator cabin.

9. The apparatus as recited in claim 8 wherein the hoist comprises a fraction hoist.

10. The apparatus as recited in claim 8 wherein the first direction of the elevator cabin is a vertical descent.

11. The apparatus as recited in claim 8 wherein the alarm device comprises a sound generating device.

12. The apparatus as recited in claim 8 wherein the alarm device comprises a light generating device.

13. The apparatus as recited in claim 8 comprising a digital device coupled between the electric generator and the alarm device to selectively operate the alarm device.

14. A method for powering an alarm device, comprising:

releasing an elevator cabin to cause the elevator cabin to descend in a tower;

causing the elevator cabin to rotate a sheave that is frictionally coupled to a suspension cable; and causing the sheave to rotate a motor such that the motor generates electrical power as a result of the rotation, the electrical power providing power to an alarm device;

wherein current generated by rotation of rotor or stator winding in said motor is used to provide electromotive braking of the elevator cabin.

15. The method for powering an alarm device as recited in claim 14, further comprising:

coupling the elevator cabin to the suspension cable wherein the suspension cable is fixed to a structure of a vertical tower.

16. The method for powering an alarm device as recited in claim 14 wherein the motor is a component of a hoist.

17. The method as recited in claim 16 wherein the hoist is either a traction hoist or a drum hoist.

18. The method as recited in claim 14 wherein the alarm device generates a sound when power is applied to it.

19. The method as recited in claim 14, wherein the motor generates an alternating current and wherein the current is converted to a direct current before applying the power to the alarm device.

20. The method as recited in claim 14 wherein the step of releasing the elevator cabin comprises releasing a manual break.

* * * * *